US007083274B2

(12) United States Patent
Morita et al.

(10) Patent No.: US 7,083,274 B2
(45) Date of Patent: Aug. 1, 2006

(54) INKJET RECORDING APPARATUS

(75) Inventors: Naoki Morita, Ebina (JP); Hiroaki Satoh, Ebina (JP); Akira Mihara, Ebina (JP); Hiroshi Ikeda, Ebina (JP); Ryo Ando, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/942,942

(22) Filed: Sep. 17, 2004

(65) Prior Publication Data

US 2005/0063753 A1 Mar. 24, 2005

(30) Foreign Application Priority Data

Sep. 19, 2003 (JP) ..... 2003-328422

(51) Int. Cl.
*B41J 2/155* (2006.01)
*B41J 13/08* (2006.01)
*B41J 2/185* (2006.01)

(52) U.S. Cl. ..... 347/104; 347/29; 400/629

(58) Field of Classification Search ..... None
See application file for complete search history.

(56) References Cited

U.S. PATENT DOCUMENTS 5,625,385 A * 4/1997 Suzuki ..... 347/24
6,585,350 B1 * 7/2003 Barinaga ..... 347/33
6,672,705 B1 * 1/2004 Kitahara et al. ..... 347/42
6,767,073 B1 * 7/2004 Tschida ..... 347/13
2002/0171699 A1 * 11/2002 Choi ..... 347/19

FOREIGN PATENT DOCUMENTS

| | | |
|---|---|---|
| JP | 05-104705 | 4/1993 |
| JP | 06-126943 | 5/1994 |
| JP | 07-186386 | 7/1995 |
| JP | 07-251505 | 10/1995 |
| JP | 08-132700 | 5/1996 |
| JP | 10-095113 | 4/1998 |
| JP | 11034360 A * | 2/1999 |
| JP | 2001-293871 | 10/2001 |
| JP | 2001-301199 | 10/2001 |
| JP | 2002-059559 | 2/2002 |
| JP | 2002-103598 | 4/2002 |

* cited by examiner

*Primary Examiner*—Daniel J. Colilla
(74) *Attorney, Agent, or Firm*—Morgan, Lewis & Bockius, LLP

(57) ABSTRACT

Plural unit heads are disposed in a paper conveyance direction, and recording head units are configured and disposed in a staggered manner. Head recovery devices are disposed as positions avoiding the locus of splattering of ink droplets from the unit heads. The recording head units can record an image across the entire width of a sheet of paper, and it is not necessary to move the recording head units in the paper width direction. Dummy jetting can be conducted at gap regions between two sheets of paper in an image recording section. The plural unit heads are unitized.

16 Claims, 13 Drawing Sheets

INKJET RECORDING APPARATUS

CROSS-REFERENCE TO RELATED APPLICATION

This application claims priority under 35 USC 119 from Japanese Patent Application No. 2003-328422, the disclosure of which is incorporated by reference herein.

BACKGROUND OF THE INVENTION

1. Field of the Invention

The present invention relates to an inkjet recording apparatus, and in particular to a recording apparatus used as an output device, such as an ink-jet recording apparatus that conducts recording by discharging ink droplets onto a recording medium, and a fax machine, a copier, a printer composite device and a workstation disposed with such a function.

2. Description of the Related Art

Among inkjet recording apparatuses that record an image by discharging ink droplets onto a recording medium such as paper, there is a so-called scanning format inkjet recording apparatus where an inkjet recording head is disposed in a moving member such as a carriage and moving of the inkjet recording head in the direction orthogonal to the recording medium conveyance direction (main scanning) and moving of the recording medium (sub-scanning) are alternately conducted.

In this scanning format inkjet recording apparatus, the manufacturing yield of the inkjet recording head is high because the inkjet recording head is compact (as the requisite minimum configuration, it suffices if there is one nozzle for one recording head).

However, a limit has arisen in the pursuit of high productivity (conducting image recording on many recording media per unit time) because reciprocal movement (main scanning) of the inkjet recording head is indispensable at the time of image recording.

In order to realize high productivity, a so-called full line head format inkjet recording apparatus has been proposed where a long inkjet recording head, which can conduct image recording across a region that is about the same as the width of the recording medium or larger, is fixed and image recording is conducted on the recording medium by conveying only the recording medium. With this format, high productivity can be achieved in comparison to the scanning format because reciprocal movement of the inkjet recording head is not necessary.

For example, Japanese Patent Application Laid-Open Publication (JP-A) No. 5-104705 discloses a recording apparatus disposed with full multi ink-jet recording heads that can simultaneously conduct recording across the entire width of the recording paper. Similarly, JP-A No. 6-126943 discloses an ink-jet recording apparatus disposed with a so-called full line type inkjet recording head.

Examples of specific configurations of such long inkjet recording heads include a configuration where, as described in JP-A No. 8-132700 for example, the length is satisfied by a combination of plural recording heads and a configuration where one recording head is integrally formed. However, advanced microfabrication technology is required in order to configure a long inkjet recording head with one member. In other words, because heads including several thousands to several tens of thousands of nozzles must be manufactured as an integral part, sometimes the yield becomes poor.

The length of the recording head can be increased by joining together unit heads of a short length in the width direction of the recording medium, as described in JP-A No. 7-251505, JP-A No. 7-186386, JP-A No. 10-95113, JP-A No. 2001-293871, JP-A No. 2001-301199, JP-A No. 2002-103598 and JP-A No. 2002-59559, for example.

However, with this configuration, it becomes necessary to integrally replace the long recording head even when a drawback such as nozzle clogging arises in a specific unit head, so that costs necessary for the replacement become extremely high.

SUMMARY OF THE INVENTION

The present invention has been made in light of the above-described circumstances. In accordance with a first aspect of the invention, there is provided an inkjet recording apparatus including: conveyor devices for conveying a recording medium in a recording medium conveyance direction generally orthogonal to a recording medium width direction; and plural head units that are disposed in a staggered manner so that an imaginary line connecting the head units zigzags and extends in the recording medium width direction, with each head unit including plural unit heads arranged in the recording medium conveyance direction.

These and other characteristics and advantages of the present invention will be apparent to those skilled in the art from the description of the preferred embodiment of the invention as depicted in the attached drawings and from the attached claims.

BRIEF DESCRIPTION OF THE DRAWINGS

A preferred embodiment of the invention will be described in detail based on the following figures, wherein.

DETAILED DESCRIPTION OF THE INVENTION

Figure 1A:
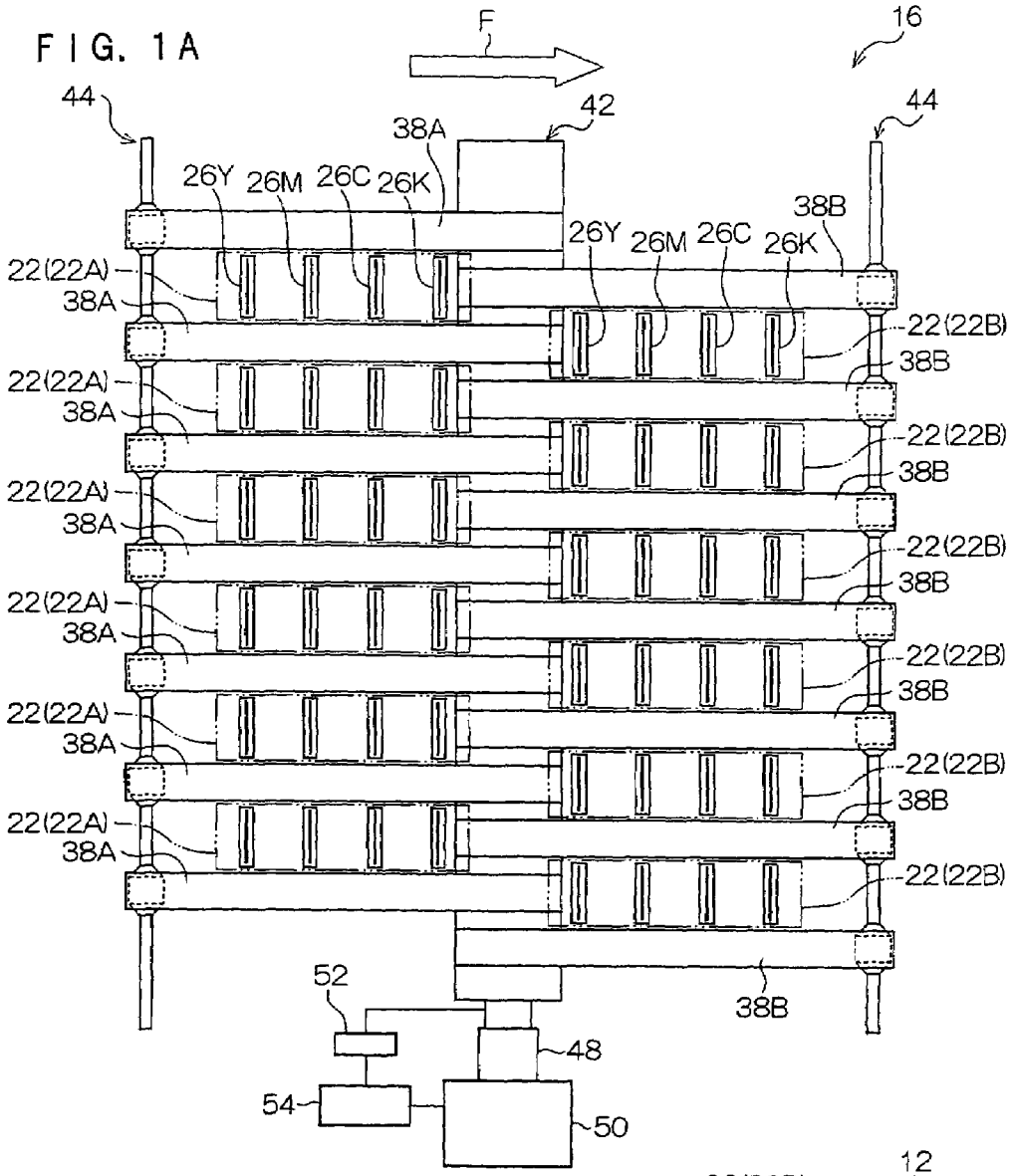
FIG. 1A is a plan view showing the schematic configuration of an ink-jet recording apparatus of an embodiment of the invention.
Figure 1B:
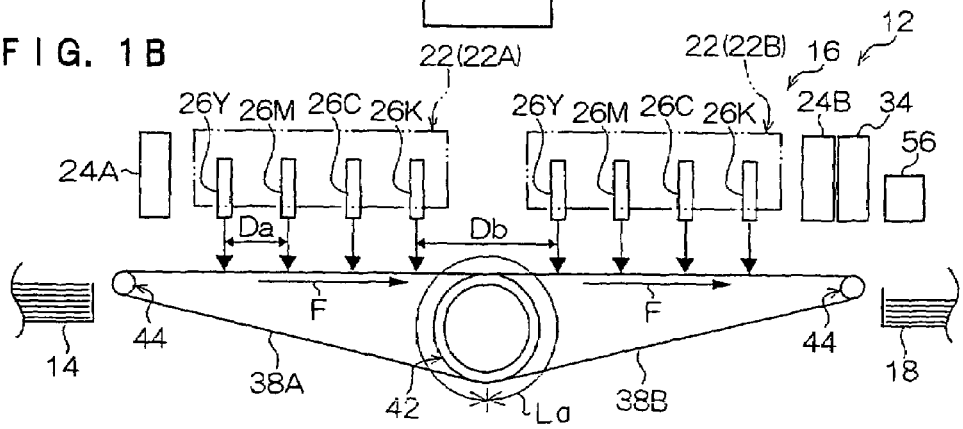
FIG. 1B is a front view of the same.

As shown in FIGS. 1A and 1B, an inkjet recording apparatus 12 pertaining to an embodiment of the invention includes a paper supply tray 14 in which paper P (one example of a recording medium) is accommodated, a recording section 16 that records an image on the paper P supplied from the paper supply tray 14, and a paper discharge tray 18 that accommodates the paper P on which an image has been recorded.

The paper P in the paper supply tray 14 is removed one sheet at a time by a pickup roller (not shown) and conveyed to the recording section 16. In the drawings, arrow F represents the paper conveyance direction, and arrow W represents the paper width direction, which is orthogonal to the paper conveyance direction.

Figure 2A:
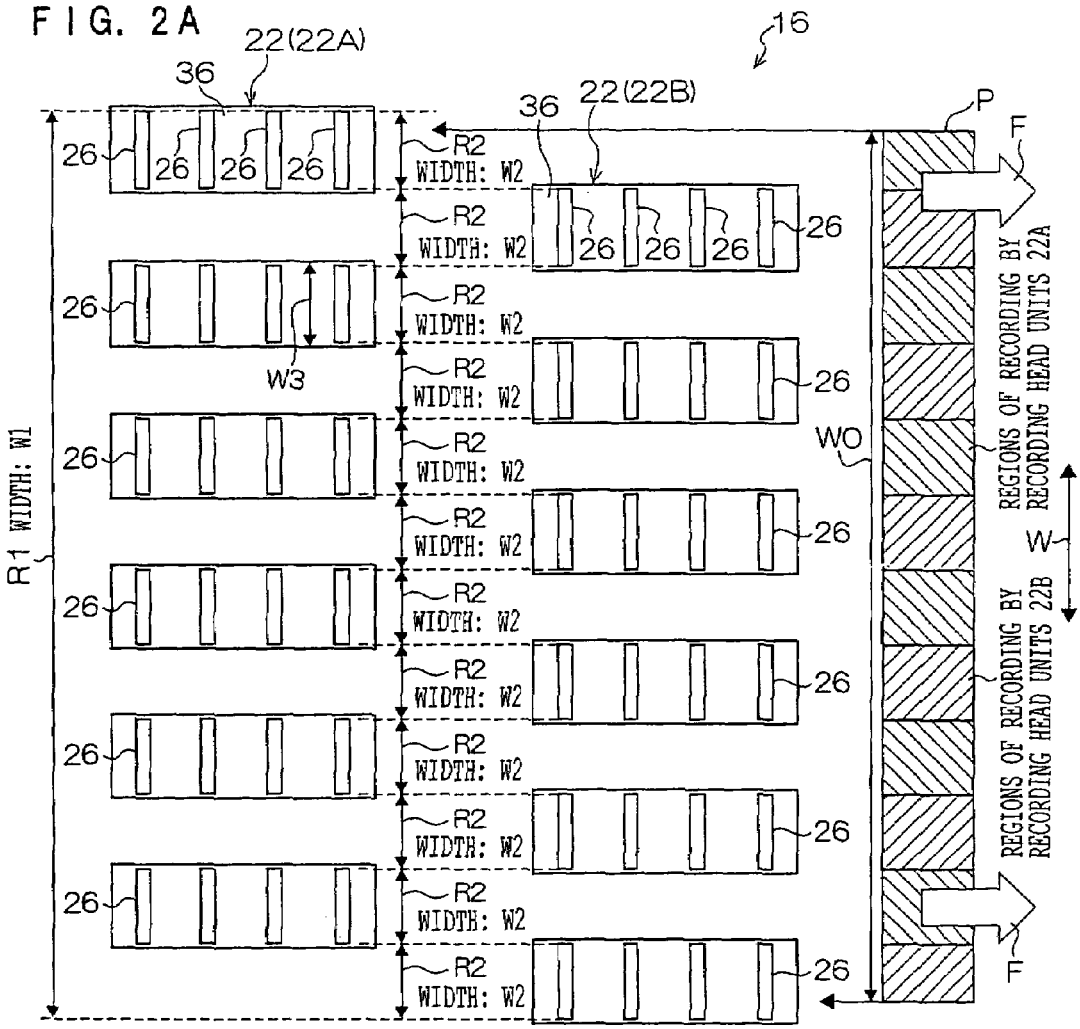
FIG. 2A is an explanatory diagram showing the relation between paper width and a recordable region of the inkjet recording apparatus of the embodiment.

As shown in FIG. 2A, the recording section 16 includes a recordable region R1 of a width W1 that is substantially the same as or wider than a maximum width W0 of the paper P for which image recording is assumed. For example, assuming an A3 size (420 mm×297 mm) sheet of paper, the maximum width W0 thereof (length in the short direction) would be 297 mm, so in the present embodiment, the width W1 of the recordable region R1 would become 304.8 mm as described later.

The recordable region R1 in the width direction of the paper P can be divided into plural individual recording regions R2. One recording head unit 22 is disposed in correspondence to and facing each recording region R2. Specifically, the recording head units 22 are positioned so that recording head units adjacent to each other in the paper width direction alternate in the conveyance direction, i.e., they are disposed in a staggered manner.

Each recording head unit 22 is detachably attached to a housing (not shown) of the inkjet recording apparatus 12.

Below, the upstream-side recording head units 22 will be referred to as recording head units 22A and the downstream-side recording head units 22 will be referred to as recording head units 22B when it is necessary to distinguish the recording head units 22 between those at the upstream side and those at the downstream side of the conveyance direction.

With respect to the paper P for which image recording has been completed, the regions recorded by the recording head units 22A and the regions recorded by the recording head units 22B are alternately arranged in the paper width direction.

As shown in FIG. 1B, a paper sensor 24A is disposed at the upstream side of the recording head units 22A, and a paper sensor 24B is disposed at the downstream side of the recording head units 22B. Each of the paper sensors 24A and 24B detect the paper P and send that information to a controller. A reading mechanism 34, which can read a test pattern recorded on the paper P, is disposed downstream of the paper sensor 24B. An imaging element such as a CCD that optically reads the test pattern can be used for the reading mechanism 34.

The recording head units 22 are configured so that plural unit heads 26 having different ink discharge characteristics are arranged along the paper conveyance direction.

Figure 3:
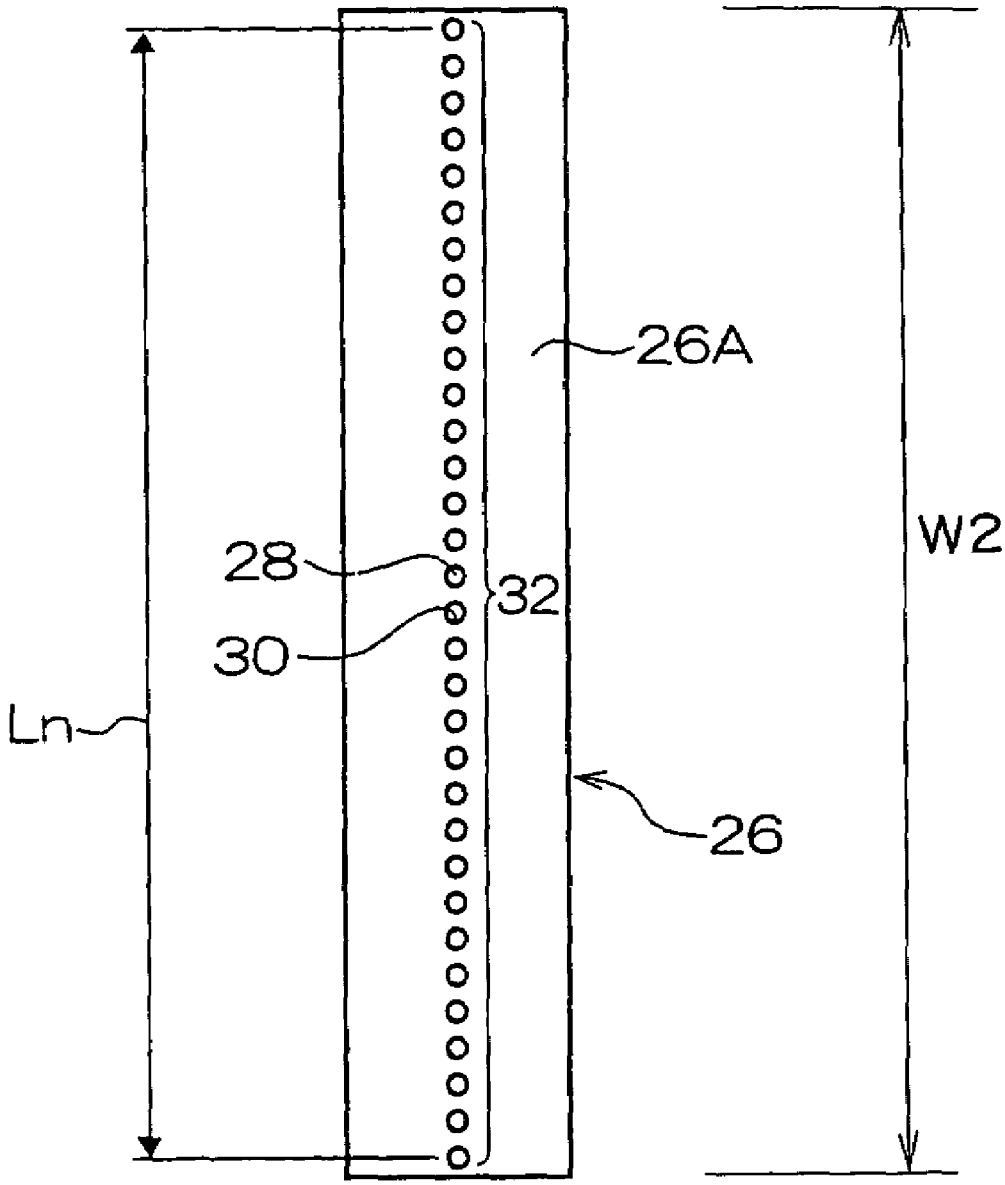
FIG. 3 is an explanatory diagram showing a unit head of the ink-jet recording apparatus of the embodiment as seen from an ink discharge surface side.

As shown in FIG. 3, each unit head 26 includes a nozzle row 32 configured by plural nozzles 28 formed along the paper width direction, and ink droplets corresponding to image information are discharged from ink discharge ports 30 at the ends of the nozzles 28.

As will be understood from FIG. 1A, in one recording head unit 22, the unit heads 26 are disposed so that both end positions of the nozzle rows 32 overlap. Also, when seen in the paper conveyance direction, the recording head units 22A and the recording head units 22B are disposed so that they are aligned or overlap in the paper conveyance direction without gaps arising in the dots on the paper P resulting from the ink droplets discharged from the unit heads 26. Thus, although the recording head units 22 record an image on the paper P in only the corresponding individual recording regions R2 (widths W2), it becomes possible to record an image across the entire width of the paper P with all of the recording head units 22. As described above, in a case where the unit heads 26 are disposed so that the dots from the unit heads 26 overlap in the paper width direction, one of the two nozzles 28 corresponding to the overlapping portion can be placed in disuse.

Figure 4A:
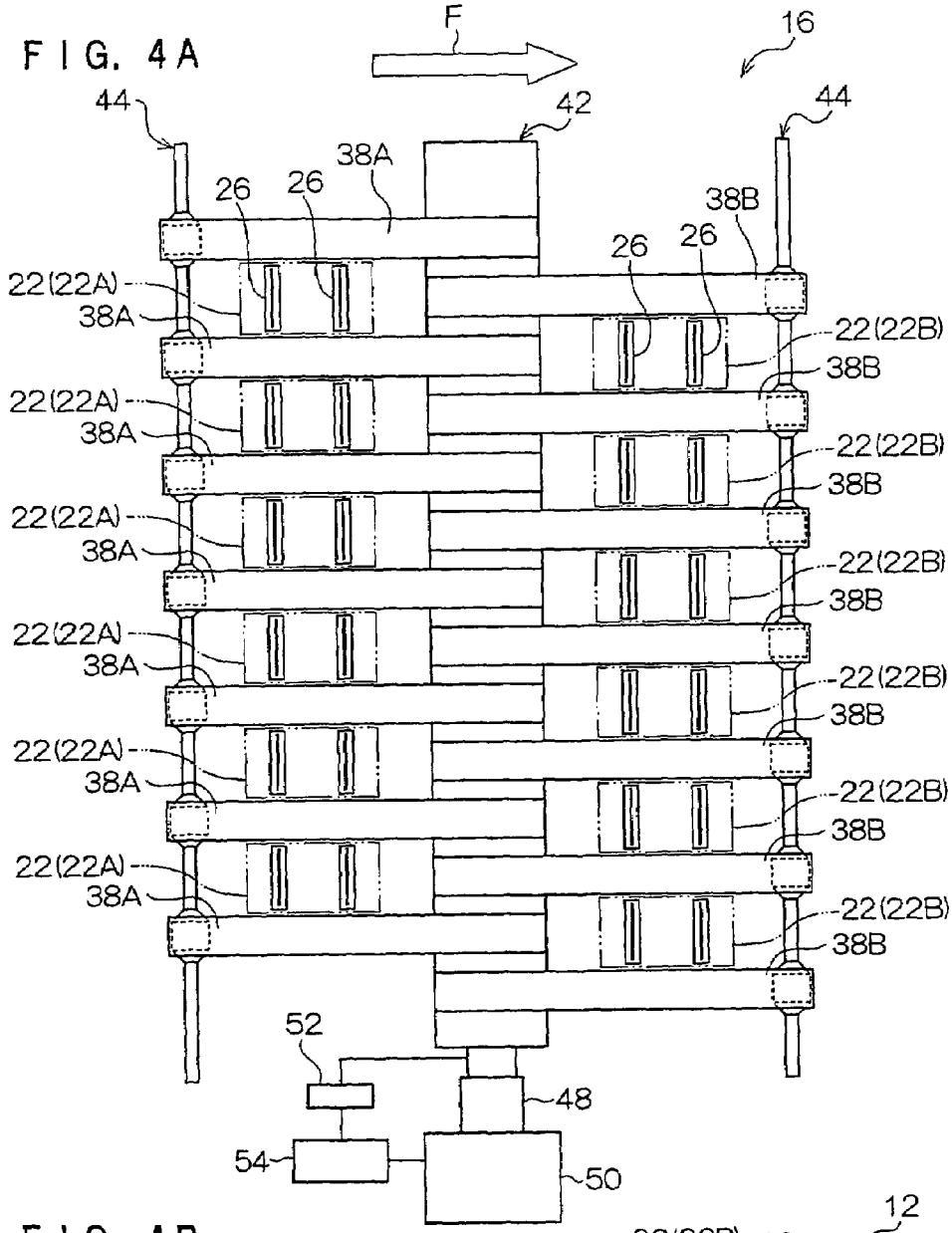
FIG. 4A is a plan view showing the schematic configuration of a modified example of the inkjet recording apparatus.
Figure 4B:
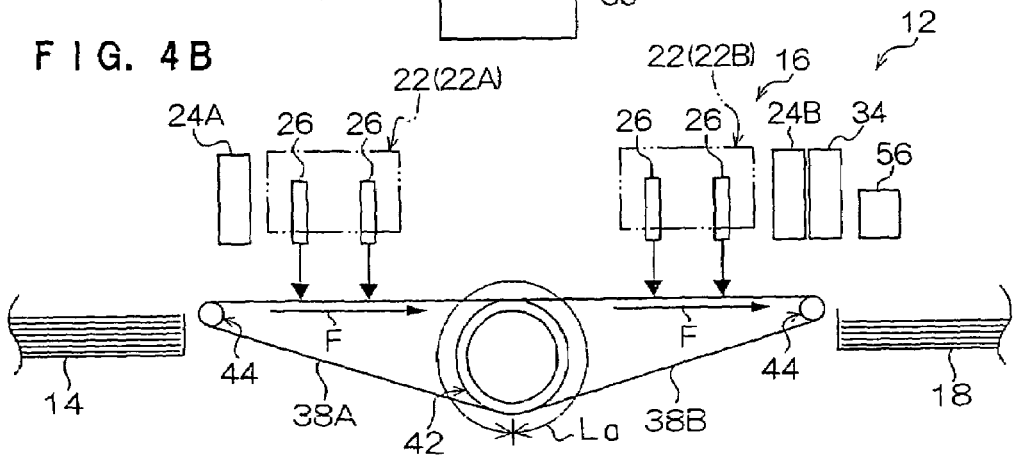
FIG. 4B is a front view of the same.
Figure 5A:
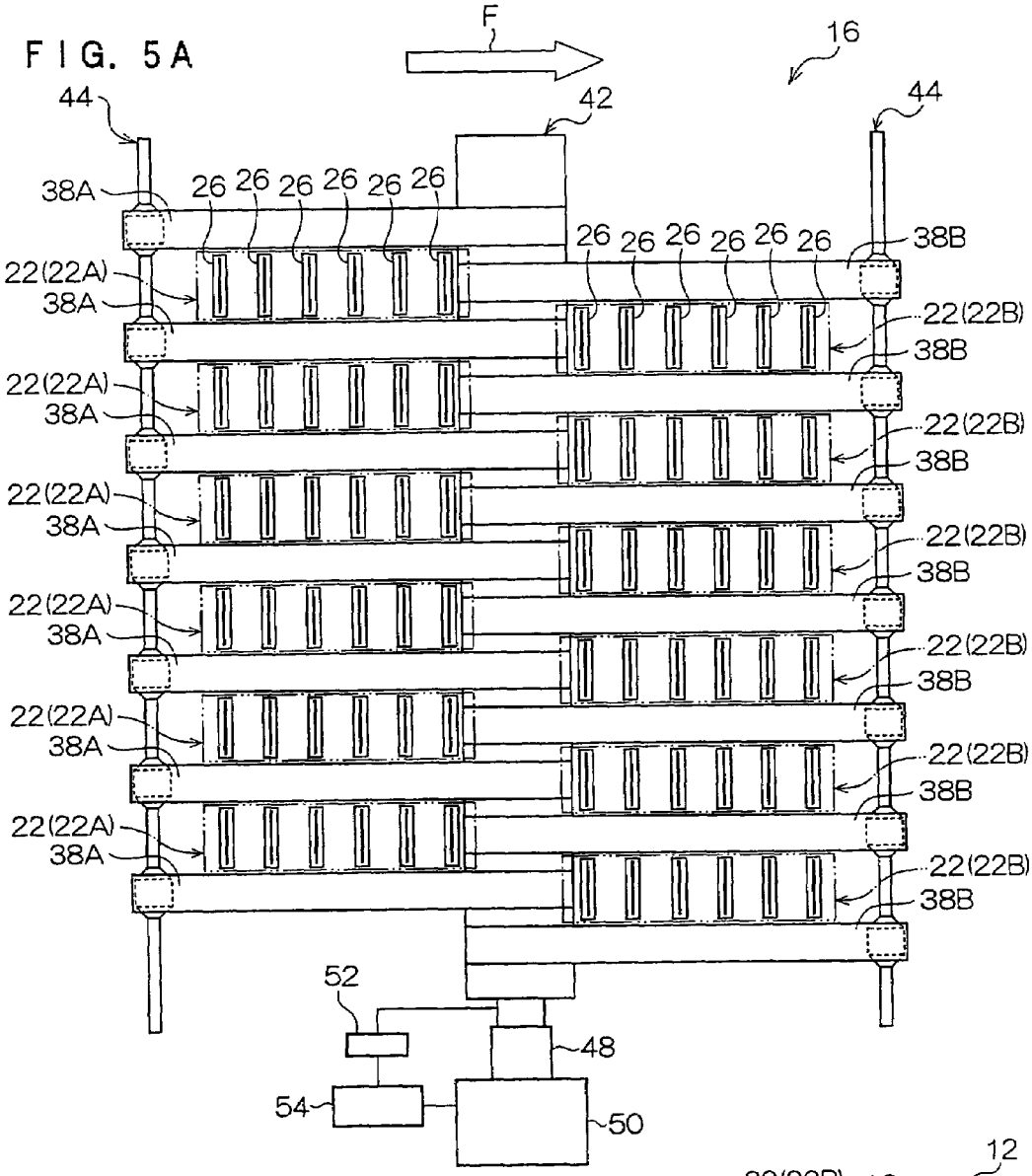
FIG. 5A is a plan view showing the schematic configuration of another modified example of the inkjet recording apparatus.
Figure 5B:
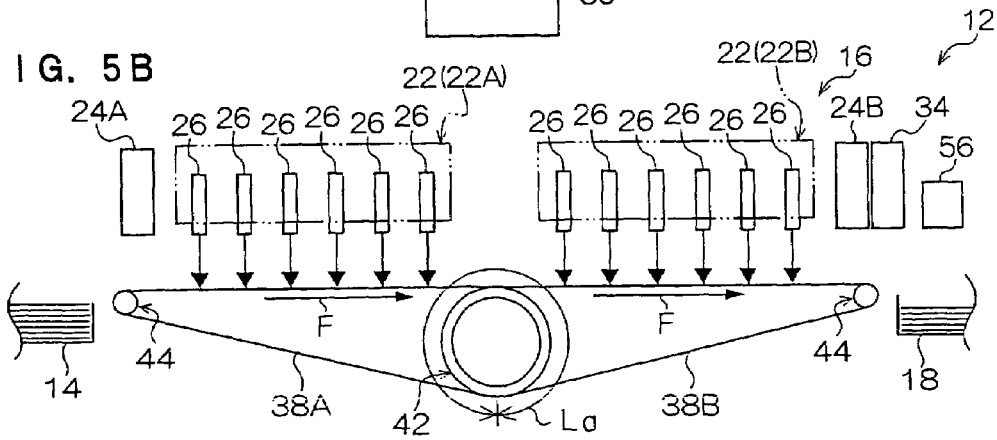
FIG. 5B is a front view of the same.

The aforementioned "ink discharge characteristics" refers to the characteristics of the ink droplets that are discharged, and include the color, droplet volume and discharge speed of the ink droplets, for example. In the present embodiment, there are four unit heads 26 per recording head unit 22, and the colors of yellow (Y), magenta (M), cyan (C) and black (K) are allocated in this order from the conveyance direction upstream side. Thus, full color image recording becomes possible (below, Y, M, C or K will be added to the ends of reference numerals when it is necessary to distinguish the unit heads 26 on the basis of color). Of course, a configuration other than this is possible. For example, as shown in FIGS. 4A and 4B, there may also be two unit heads 26 per recording head unit 22, and different colors (e.g., black and a highlight color) may be allocated to each unit head 26, so that a two-color image is recordable. Also, as shown in FIGS. 5A and 5B, there may be five or more unit heads 26 per recording head unit 22, so that colors other than Y, M, C and K (e.g., pale cyan or pale magenta) are added and a configuration with higher color reproducibility is possible. Moreover, higher gradation can be obtained even with unit heads 26 corresponding to the same colors by configuring the unit heads 26 so that the ink droplet volumes are different.

Figure 6:
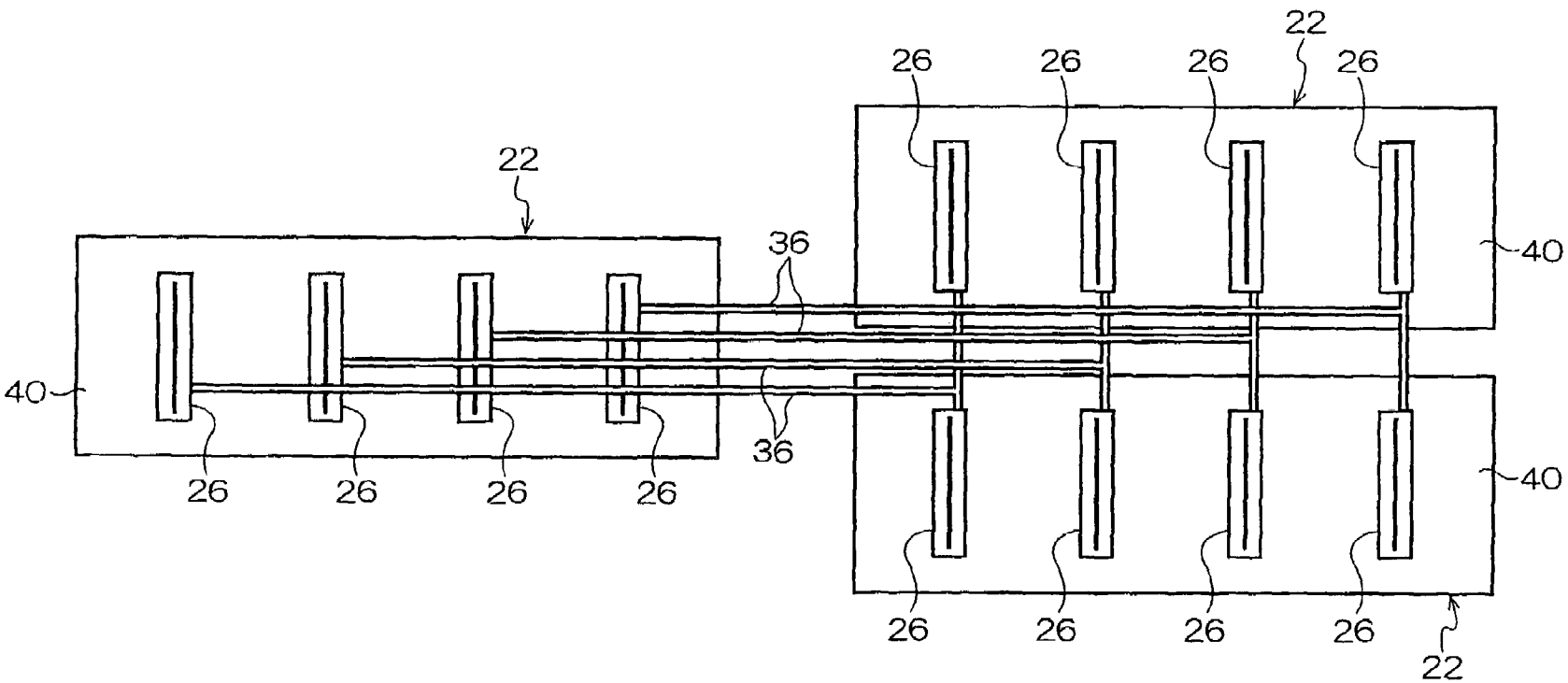
FIG. 6 is an explanatory diagram showing an ink supply system of the embodiment.

As shown in FIG. 6, the ink is supplied to each unit head 26 through ink supply paths 36 from ink tanks (not shown). By disposing the ink supply paths 36, which are shared by the plural unit heads 26, in this manner, the overall balance of the plural unit heads 26 (recording head units 22) can be improved, which is preferable. Similarly, it is preferable for a drive signal supply system for driving the unit heads 26 to be shared by the plural unit heads 26 so that the overall balance is improved.

Figure 7A:
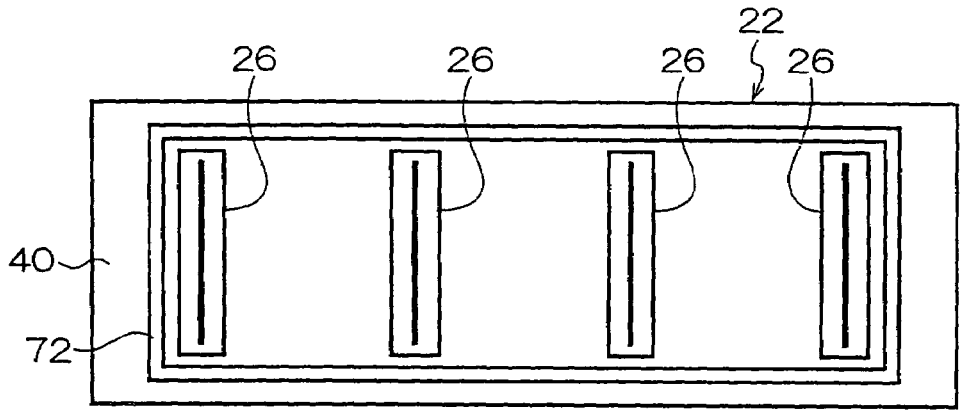
FIG. 7A is a bottom view of a recording head unit and shows the relation between the recording head unit and a cap member of the embodiment.
Figure 7B:
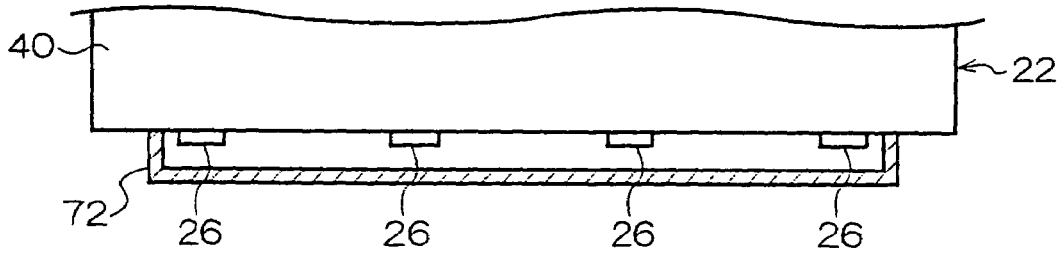
FIG. 7B is a front view of the same.

As mentioned above, each recording head unit 22 is configured by integrating and unitizing plural unit heads 26 as one recording head unit. As shown in FIGS. 7A and 7B, each recording head unit 22 includes a recording head housing 40 that can retain the plural unit heads 26 at relatively constant intervals. In a state where the unit heads 26 are attached to the recording head housing 40, the relative positions thereof do not shift.

When seen in plan view, each recording head housing 40, which has a predetermined width W3 for correspondence (e.g., securement of pressure-welded portion at a capping time) with electrical wiring, ink supply and later-described head recovery devices 70, protrudes further outward in the paper width direction than the nozzle rows 32 of the unit heads 26. If these protruding portions are large, mutually adjacent recording head housings 40 interfere with each other when the recording head units 22 are arranged in the paper width direction. In order to prevent this from happening, a countermeasure such as adding more recording head units 22 in the medium conveyance direction to make three rows is conceivable to enable recording across the entire width of the paper P, but in this case, the apparatus unavoidably becomes larger.

In the present embodiment, which eliminates this problem, the width W3 of each recording head housing 40 is set to be equal to or less than twice the length Ln (see FIG. 3) of the nozzle row 32 of the unit heads 26. Thus, as shown in FIG. 2A, a so-called staggered disposition can be used where two rows configured by arranging recording heads at a predetermined pitch in the paper width direction are disposed in the paper conveyance direction and the recording heads of one row and the recording heads of the other row are shifted at half pitch. Thus, the recording head housings 40 do not physically interfere with each other. Additionally, complete recording (printing) across the entire width of the paper P is possible even if the width of the paper P is quite wide.

As long as the above condition is satisfied, it is not necessary for the recording head housings 40 to be formed in rectangular shapes when seen in plan view; the recording head housings 40 can have polygonal shapes or shapes where protrusions are formed at the outer sides thereof.

In the present embodiment, the length of the nozzle row 32 of each unit head 26 is 25.4 mm (1 inch), for example. Two rows (in the paper conveyance direction) of six (in the paper width direction) recording head units 22 disposed with these unit heads 26 are disposed, for a total of twelve recording head units 22. Overall, nozzle rows 32 of 25.4 mm are arranged without gap when seen in the paper width direction, so that the recordable region R1 has a width of 304.8 mm. The number of recording head units 22 can be appropriately set in accordance with the recordable range (length of nozzle row 32) per unit head 26. For example, in a case where the length of the nozzle row 32 is twice the length described above (i.e., 50.8 mm (2 inches)), image recording of an entire A4 longitudinal direction (A3 short direction) becomes possible by disposing three recording head units in each row in the paper width direction, for a total of six recording head units 22. Also, in a case where an image is to be recorded on paper having a width greater than this, the invention can have a configuration where all of the recording head units 22 are mounted on a carriage, these are integrally moved (main scanning), and main scanning and conveyance of the paper (sub-scanning) are alternately conducted. In this case, main scanning can be conducted two times or four times to match the size of the paper, or so-called over-striking can be done. In this manner, the final image recording efficiency rises dramatically even with a configuration where the recording head units 22 are moved because the recording region per one-time main scanning is wide.

As shown in FIG. 1A, medium conveyor belts 38 are disposed in regions (called non-recording regions below) of the recordable region R1 where the ink droplets are not discharged from the recording head units 22 (unit heads 26), i.e., at positions avoiding the locus of splattering of the ink droplets from the unit heads 26. Because the non-recording regions are positioned in the paper width direction so as to alternate with the recording head units 22, plural medium conveyor belts 38 are disposed at equidistant intervals in the paper width direction. Additionally, because upstream-side medium conveyor belts 38A and downstream-side conveyor belts 38B are disposed so as to be staggered by the widths (W2) of the individual recording regions R2 in the paper width direction, the medium conveyor belts 38 are disposed in a staggered manner overall.

Thus, in the present embodiment, when the recordable region R1 is seen in the paper width direction, the recording head units 22A or the recording head units 22B are respectively disposed in the individual recording regions R2 at constant periods (pitches). Moreover, the medium conveyor belts 38A or the medium conveyor belts 38B are disposed at constant periods in the non-recording regions. Thus, the recording head units 22 and the medium conveyor belts 38 are alternately disposed.

Due to friction with the paper P, or by circulating (rotating) in a predetermined direction while electrostatically or non-electrostatically retaining the paper P, the medium conveyor belts 38 convey the paper P. Examples of non-electrostatic retention methods include suction and adhesion.

One drive roller 42 that spans the paper width direction is rotatably supported at an unillustrated paper conveyance frame in the center of the paper conveyance direction of the recording section 16. The upstream-side medium conveyor belts 38A and the downstream-side conveyor belts 38B are alternately wound around and retained at the drive roller 42.

One driven roller 44 that spans the paper width direction is disposed in both the vicinity of the upstream end and the vicinity of the downstream end of the paper conveyance direction and is rotatably supported via bearings at a driven roller frame 46 in the paper conveyance frame. As shown in FIG. 1A, the medium conveyor belts 38A and the medium conveyor belts 38B are wound around and retained at the corresponding driven rollers 44.

The drive roller 42 is connected via a gear 48 (or directly) to a drive motor 50. The drive motor 50 serves as a drive source for the medium conveyor belts 38. All of the medium conveyor belts 38 can be circulated (rotatingly driven) at the same circulation speed by the rotation of the drive roller 42 resulting from the drive of the drive motor 50. Thus, unevenness in the quality of a recorded image between the recording head units 22A and 22B can be eliminated, and a high-quality image can be obtained. A stepping motor can be used as the drive motor 50, so that highly precise paper conveyance control is possible, but the drive motor 50 is not limited thereto.

An encoder 52 that outputs predetermined pulses in synch with the rotation of the drive roller 42 is disposed at the drive roller 42. A drive motor control device 54 controls the rotation of the drive motor 50 on the basis of these output pulses, so that unevenness in the rotation of the drive roller 42 arising from the output shaft of the drive motor 50 or eccentricity of the gear 48 or the drive roller 42 can be controlled within a fixed range.

The drive motor control device 54 is not limited to any format or structure as long as it can execute the above-described control. For example, a device that conducts eccentricity control by reading, from the individual encoder signals at the time of rotation of the drive roller 42, differences with the ideal rotation of the drive roller 42, i.e., the eccentric error component, can be used.

As shown in FIG. 1B, the peripheral length La of the drive roller 42 is made sufficiently long in comparison to the inter-nozzle distance Da of the unit heads 26 in the recording head units 22. Thus, even when the drive roller 42 is rotating eccentrically, color shifts accompanying periodic fluctuations in the conveyance speed resulting from this, or shifts in the landing positions of the ink droplets between the unit heads, can be prevented. Namely, there are usually cases where the drive roller 42 rotates eccentrically, albeit slightly, even when it is attached to the paper conveyance frame with high precision. Even if the drive roller 42 is rotated at a constant angle speed, periodic fluctuations arise in the circulation speed of the medium conveyance belts 38 due to this eccentricity, and the conveyance speed of the paper P also periodically fluctuates. Here, in light of an optional place on the paper P, the difference between the conveyance speed when the ink droplets are discharged from the unit heads 26 of the recording head units 22 at this optional place and the conveyance speed when the ink droplets are discharged from different unit heads 26 of the same recording head unit 22 becomes small. For this reason, shifts in the positions at which the dots formed by the ink droplets from the unit heads 26 land also become small to the extent that they do not actually become a problem. For example, in a case where affects resulting from eccentric error of the drive roller 42, i.e., the maximum amount of positional fluctuations in the conveyance direction of each color of the ink droplets discharged from the unit heads 26 is 100 μm, the error of the landing positions of the ink droplets from adjacent unit heads 26 becomes 30 μm or less by making the inter-nozzle distance Da in the recording head units 22 to be 1/10 or less the period length La', so that an image where there are no practical problems can be obtained.

Also, because the period length of the drive roller 42 is sufficiently long with respect to the inter-nozzle distance Db between the nozzles 28 of the most downstream unit heads 26 of the recording head units 22A and the nozzles 28 of the most upstream unit heads 26 of the recording head units 22B, shifts in the dots resulting from the ink droplets from these two groups of nozzles 28 can be eliminated.

Figure 2B:
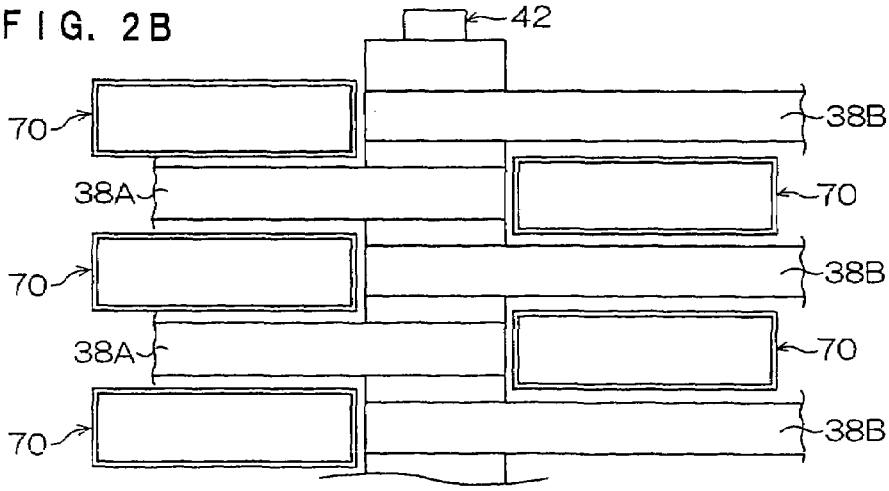
FIG. 2B is an explanatory diagram showing the positions of medium conveyor belts and belt recovery devices.
Figure 8B:
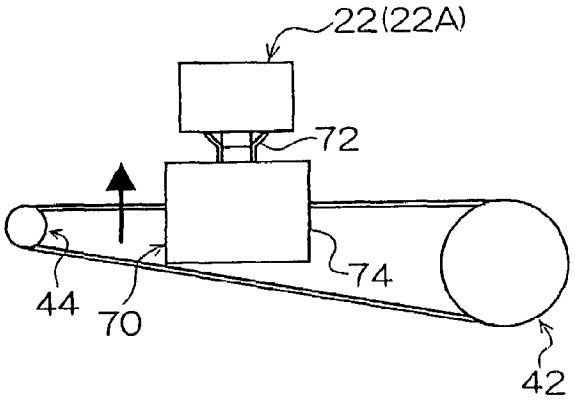
FIG. 8B is a view showing a capping time.
Figure 8A:
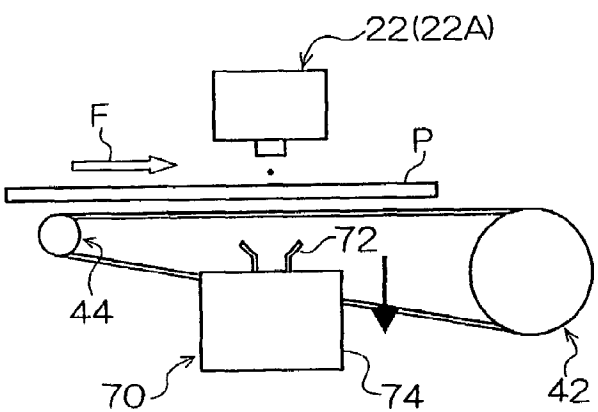
FIG. 8A is a front view showing an image recording time of the head recovery device of the embodiment.
Figure 8C:
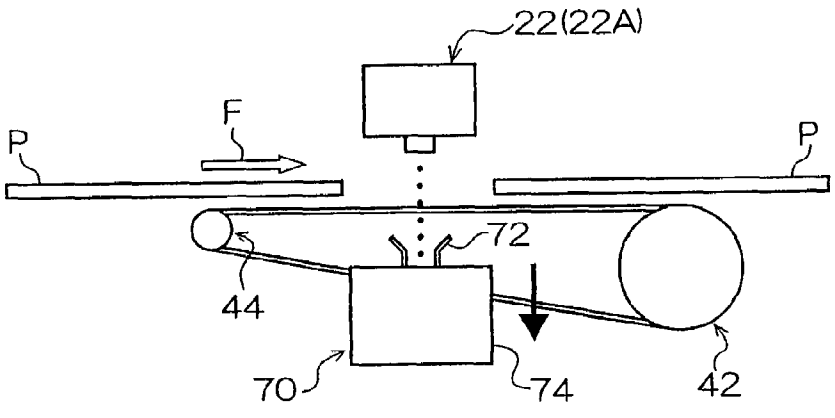
FIG. 8C is a view showing a dummy jetting time.

As shown in FIGS. 8A to 8C (FIGS. 2B, 7A and 7B), head recovery devices 70 corresponding to the recording head units 22 in a 1:1 ratio are disposed at positions facing the recording head units 22 with the conveyed paper P sandwiched between the recording head units 22 and the head recovery units 70, i.e., the head recovery devices 70 are disposed in regions where the medium conveyor belts 38A and 38B are not disposed. In FIGS. 8A to 8C, only the relation between the upstream-side driven roller 44 and the drive roller 42 is shown, but head recovery devices 70 are similarly disposed between the drive roller 42 and the downstream-side driven roller 44. Also, the drawings seem to show that the recording head unit 22 is disposed with only one unit head 26, but in actuality plural unit heads 26 are disposed.

Each head recovery device 70 includes at least a cap member 72 that opens towards the recording head unit 22 and a retention member 74 that retains this cap member 72. The retention member 74 is lifted and lowered (so that the retention member 74 moves towards and away from the recording head unit 22) by an unillustrated lifting/lowering mechanism. Moreover, as needed, a suction device that sucks the inside of the cap member 72 is disposed.

As shown in FIG. 8B, in a state where the head recovery device 70 is lifted, the cap member 72 tightly contacts and caps the recording head unit 22 so that the nozzle rows 32 (see FIG. 3) of all the unit heads 26 are surrounded. Thus, the cap member 72 prevents inadvertent drying of the ink, prevents clogging of the nozzles 28 resulting from thick ink, and prevents deterioration of the ink. Also, in this state, a so-called vacuum operation is conducted so that the ink is forcibly sucked from the nozzles 28 of the unit heads 26.

In contrast, in a state where the head recovery device 70 is lowered, as shown in FIG. 8A, the paper P is conveyed by the medium conveyor belts 38A and 38B and becomes passable under the unit heads 26, so that image recording on the paper P can be conducted. Also, as shown in FIG. 8C, when the paper P is not present directly under the recording head units 22 (e.g., between two sheets of paper P), so-called dummy jetting is conducted from the unit heads 26 so that the ink droplets thereof can be received by the cap member 72.

The lifting/lowering mechanism of the head recovery device 70 may be disposed separately in each head recovery device 70 or may be disposed in common with plural head recovery devices 70. When the lifting/lowering mechanism is shared by the plural head recovery devices 70, it can be configured so that the plural recovery devices 70 are fixed on a common base plate and the base plate itself is lifted and lowered.

Also, as mentioned above, it is preferable for the head recovery devices 70 to be able to cap the recording head units 22, but there are also cases where, depending on the configuration of the inkjet recording apparatus 12, it suffices as long as they can receive the dummy-jetted ink. Regardless of the configuration, disposing the head recovery devices 70 in a 1:1 ratio with the recording head units 22 so that they correspond to all of the plural unit heads 26 configuring the recording head units 22 is preferable in terms of making the overall inkjet recording apparatus 12 compact and inexpensive.

Because image recording across the entire width of the paper P is possible by disposing the recording head units 22A and 22B so that they cover all of the individual recording regions, they may also have a random disposition in the width direction of the paper P. However, in consideration of the width of the head recovery devices 70, when the recording head units 22A and 22B are disposed at constant periods in the width direction of the paper P so that a certain amount of space is formed between the recording head units 22A or the recording head units 22B, adjacent head recovery devices 70 do not interfere with each other even if the width of the head recovery devices 70 is wide, and restrictions in terms of disposition are reduced, which is preferable.

Similarly, it is preferable for the medium conveyor belts 38A and 38B to be able to reliably convey the paper P and be disposed at positions avoiding the locus of splattering of the ink droplets from the unit heads 26, but they may also have a random disposition in the width direction of the paper P. However, it is preferable to dispose the medium conveyor belts 38A and 38B at constant periods in the width direction of the paper P so that they can reliably convey the paper P.

The inkjet recording apparatus 12 records an image on the paper P on the basis of an instruction from the controller (not shown).

This image recording operation will be described below.

In a state where there is no instruction from the controller, the ink-jet recording apparatus 12 is in a standby state and each element is stopped. Each head recovery device 70 is lifted as shown in FIG. 8B so that the cap member 72 tightly contacts the corresponding recording head unit 22 to prevent clogging of the nozzles 28 and deterioration of the ink.

When there is an instruction from the controller to conduct image recording, the inkjet recording apparatus 12 lowers each head recovery device 70 as shown in FIG. 8A, so that the paper P can pass under the recording head units 22. In accordance therewith, the drive motor 50 is driven, causing the drive roller 42 to rotate so that the medium conveyor belts 38A and 38B circulate and are driven. At this time, a signal from the encoder 52 is received, eccentricity control is conducted and the drive motor 50 is rotated. In this manner, in a state where the circulation speed of the medium conveyor belts 38A and 38B is stable, the controller drives the pickup roller (not shown) to send the paper P one sheet at a time from the paper supply tray 14 to the recording section 16.

When the paper sensor 24A detects the leading end of the paper P, the controller drives each unit head 26 on the basis of this detection signal so that the unit heads 26 discharge the ink droplets at a predetermined timing. Thus, ink droplets corresponding to image information are successively discharged to predetermined positions on the paper P from the unit heads 26 most upstream in the conveyance direction, and image recording is conducted. Because the conveyance of the paper P in this state is conducted by the medium conveyor belts 38 having a predetermined width in the paper conveyance direction and the paper width direction, the medium conveyor belts 38 can secure flatness of the paper P and stably convey the paper P with high conveyance precision.

At the point in time when discharge of the ink droplets from the head units 26 most downstream in the conveyance direction is completed, image recording on the entire paper P is completed and the paper P is discharged to the discharge tray 18. Then, when the number of sheets of the discharged paper P is counted and image recording of a predetermined number of sheets of the paper P is completed, the rotation of the drive motor 50 is stopped and the circulation of the medium conveyor belts 38A and 38B is also stopped. The number of sheets of the discharged paper P can be detected by the paper sensor 24B detecting the trailing ends of the sheets of the paper P.

As mentioned above, when images are to be recorded on plural sheets of the paper P, dummy jetting can be conducted in the empty spaces between the sheets of the moving paper P. The head recovery devices 70 corresponding to the unit heads 26 ordinarily face the recording head units 22, and when dummy jetting is to be conducted, it is not necessary to relatively move the unit heads 26 or the head recovery devices 70 in the paper moving direction. Thus, the structure of the inkjet recording apparatus 12 can be simplified and made compact. Also, the medium conveyor belts 38A and 38B are disposed in the non-recording regions, so that ink discharged in the dummy jetting does not inadvertently adhere to the medium conveyor belts 38A and 38B. Thus, it is possible to conduct dummy jetting in the regions between the sheets of paper P while conducting image recording, and high productivity can be obtained.

Thereafter, the controller causes the head recovery devices 70 to be lifted, so that the unit heads 26 are capped by the cap members 72. Thus, the series of image recording operations is completed.

In this manner, the inkjet recording apparatus 12 of the present embodiment can conduct image recording across the entire width of the paper P simply by conveying the paper P, without having to move the recording head units 22A and 22B (in the paper width direction), and productivity becomes higher.

Moreover, in the present embodiment, each recording head unit 22 is unitized, so that the recording head units 22 can be individually replaced when drawbacks such as so called clogging arises in a specific nozzle of the unit heads 26. In contrast, when the inkjet recording apparatus has a configuration where plural unit heads 26 are unitized in the paper width direction, as will be understood from FIGS. 1A and 1B, the number of unit heads 26 to be replaced increases, which leads to an increase in cost, because six (depending on the case, twelve) unit heads 26 are unitized in the paper width direction. For example, in a case where 1200 dpi unit heads are used to enable image recording on a 12 inch wide sheet of paper, 14400 nozzles per color are arranged in the width direction of the paper. When a drawback arises in only some of these nozzles, replacing the integrated unit heads across the width direction leads to an increase in cost. However, in the present embodiment, costs necessary for replacement become lower because it suffices to replace only the recording head unit 22 to which the unit head 26 including the nozzle in which the drawback has arisen is attached.

In this manner, in a configuration where the recording head units 22 (unit heads 26) are replaceable, there are cases where attachment precision of the unit heads 26 after replacement cannot be highly demanded. For example, sometimes the positional precision between the unit heads 26 is 100 μm or less due to error in the fixing time of the recording head unit 22. In a case where an image with a resolution of 1200 dpi is to be recorded, it is preferable to keep this error to about 10 to 20 μm.

Figure 9:
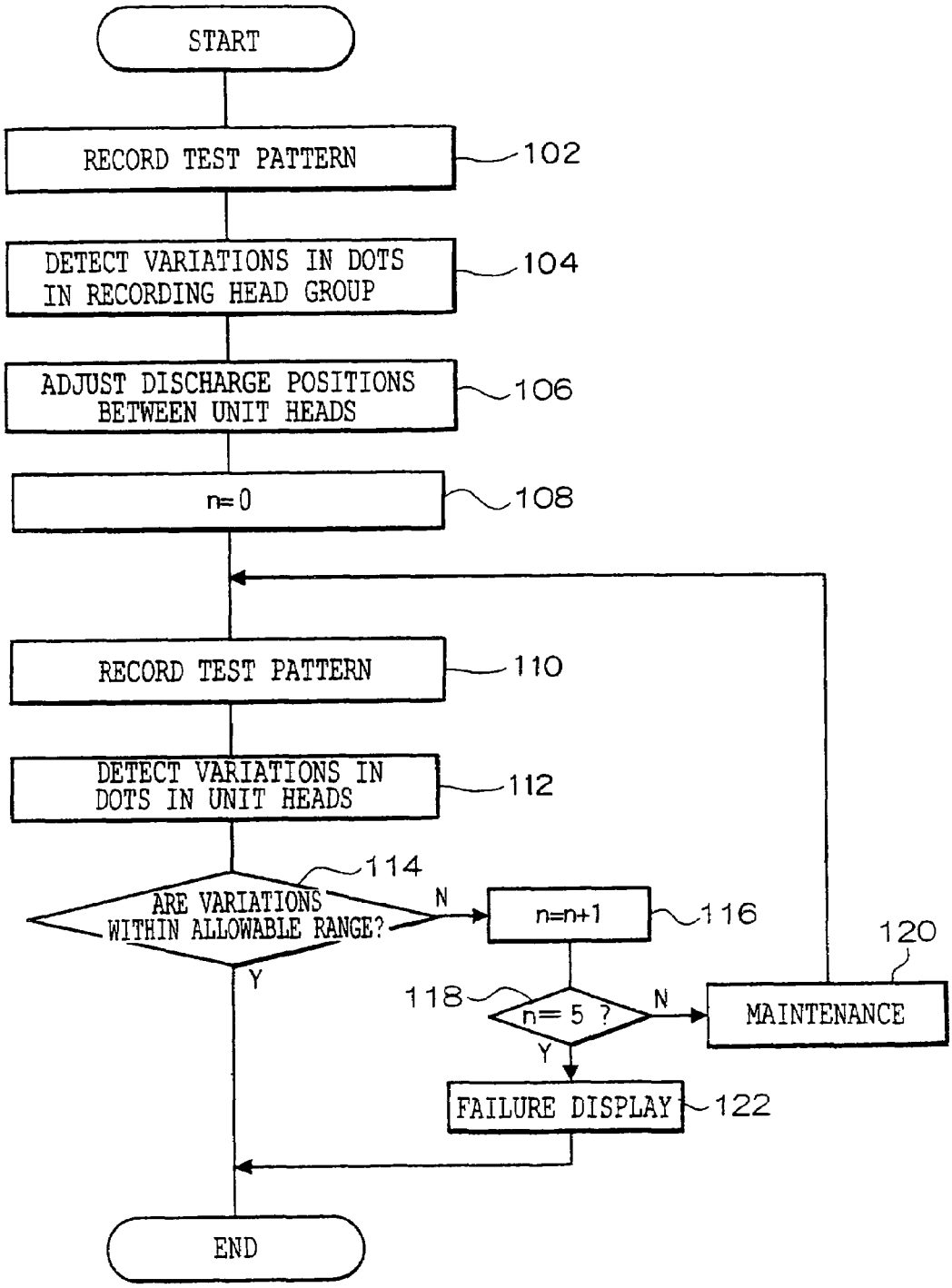
FIG. 9 is a flow chart showing the sequence of ink droplet discharge position adjustment.

The inkjet recording apparatus 12 can adjust the discharge positions between the unit heads 26 and inside the unit heads 26 by the sequence shown in FIG. 9.

Figure 10:
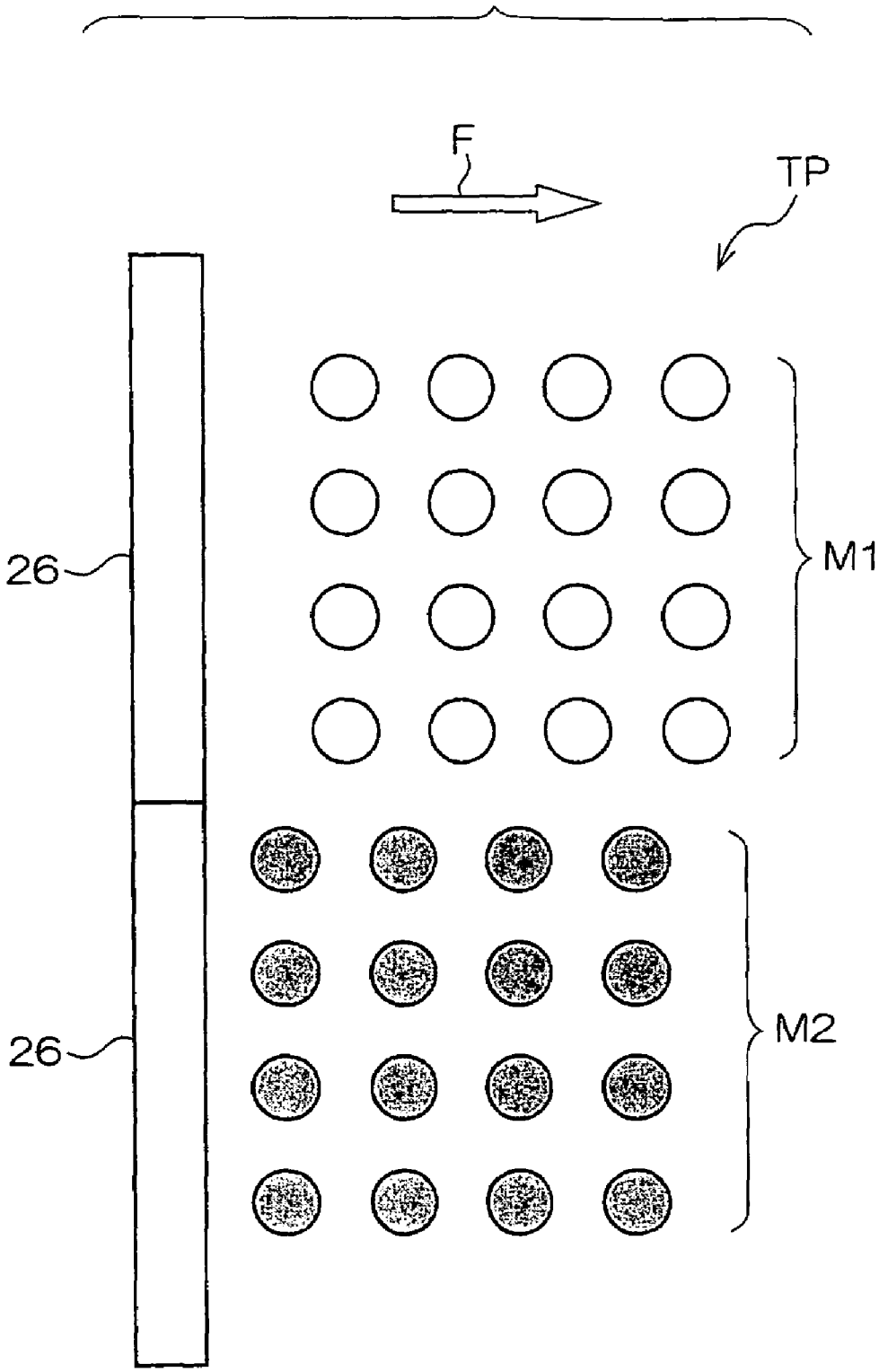
FIG. 10 is an explanatory diagram showing an example of a test pattern recorded in the ink droplet discharge position adjustment.
Figure 11:
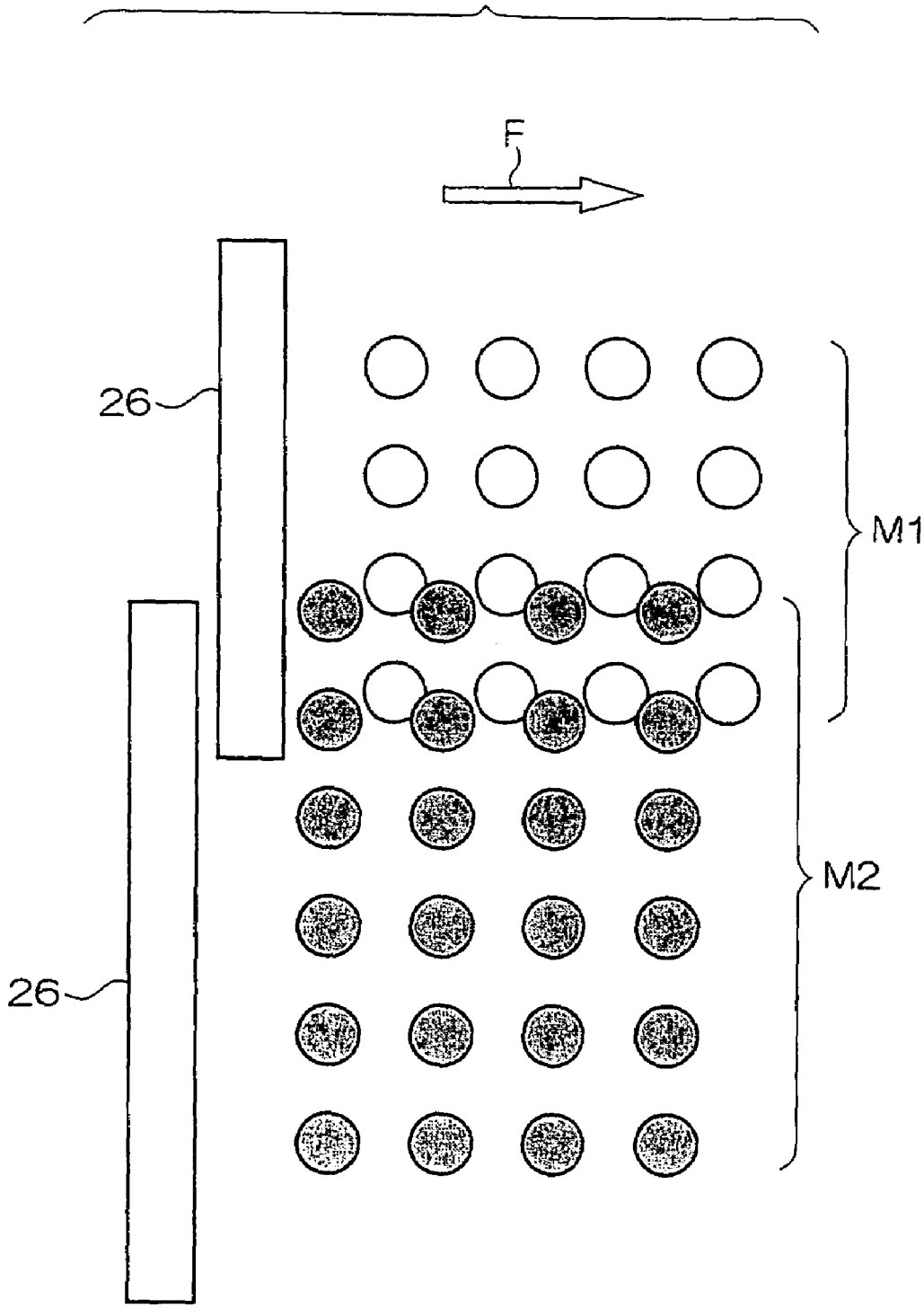
FIG. 11 is an explanatory diagram showing another example of a test pattern recorded in the ink droplet discharge position adjustment.
Figure 12:
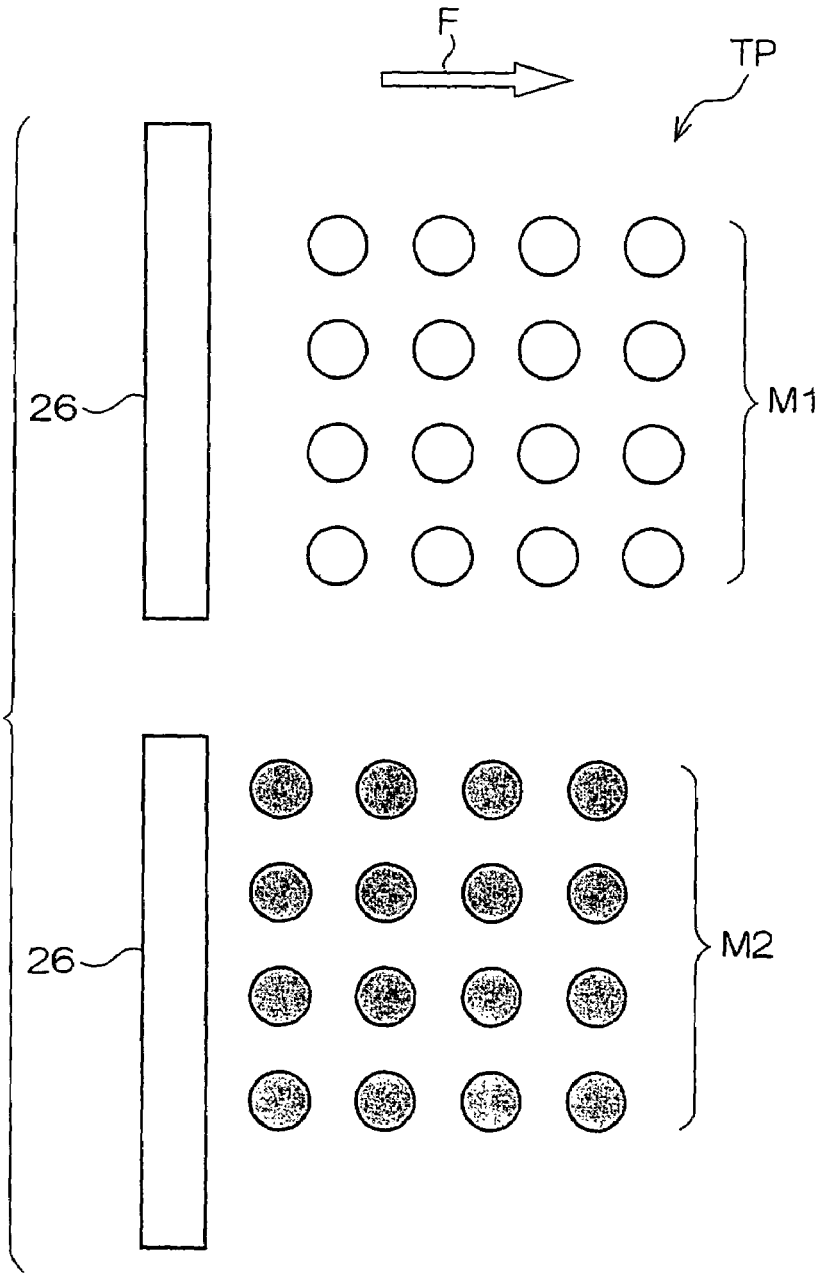
FIG. 12 is an explanatory diagram showing yet another example of a test pattern recorded in the ink droplet discharge position adjustment.

First, in step 102, a predetermined test pattern is recorded on the paper P. Although it suffices for the test pattern to be one where the landing positions of the ink droplets discharged from the nozzles 28 of the unit heads 26 can be precisely detected, it is preferable for the test pattern to be one where, for example, dots are arranged in a matrix on the paper P. FIGS. 10 to 12 show test patterns TP configured by a matrix M1, which is formed by a specific unit head 26, and a matrix M2, which is formed by a unit head 26 of the same color adjacent in the paper width direction. In FIGS. 10 to 12, the number of dots configuring the matrixes is fewer than in actuality. In the actual matrixes, the same number of dots as the nozzles configuring the nozzle row 32 are arranged in the paper width direction. Also, dots of a number corresponding to the time (discharge frequency) when the ink droplets are discharged are arranged in the paper conveyance direction.

In step 104, the test pattern TP is read by the reading mechanism 34, and the positions of the dots in the recording head units 22 are detected. With respect to the test pattern TP, there are cases where the matrix M1 and matrix M2 are shifted in the paper conveyance direction per unit head 26 (see FIG. 10), cases where the matrixes are shifted in the paper width direction, cases where the matrixes overlap in the paper width direction (see FIG. 11), and cases where (large) gaps between the matrixes arise in the paper width direction (see FIG. 12). Regardless of the case, in step 106, the discharge positions between the unit heads 26 are adjusted. The adjustment of the discharge positions can be done by changing, per recording head 26, the recording timing, i.e., the timing at which the ink droplets are discharged, when the dots are shifted in the paper conveyance direction. Also, in a case where the dots overlap in the paper width direction, the adjustment can be done so that the ink droplets are not discharged from the nozzles 28 corresponding to the overlapping portion. In a case where a gap in the paper width direction arises between the dots, ink droplets are discharged from the non-used nozzles 28 corresponding to the gap portion (in consideration of this point, it is preferable to sufficiently secure the length of the nozzle rows 32 so that non-used nozzles can be present in advance at both end portions of the nozzle rows 32). In this manner, in a state where the discharge positions between the unit heads 26 have been adjusted, the counter representing discharge abnormalities per unit head 26 is reset in step 108, so that n=0.

Figure 13:
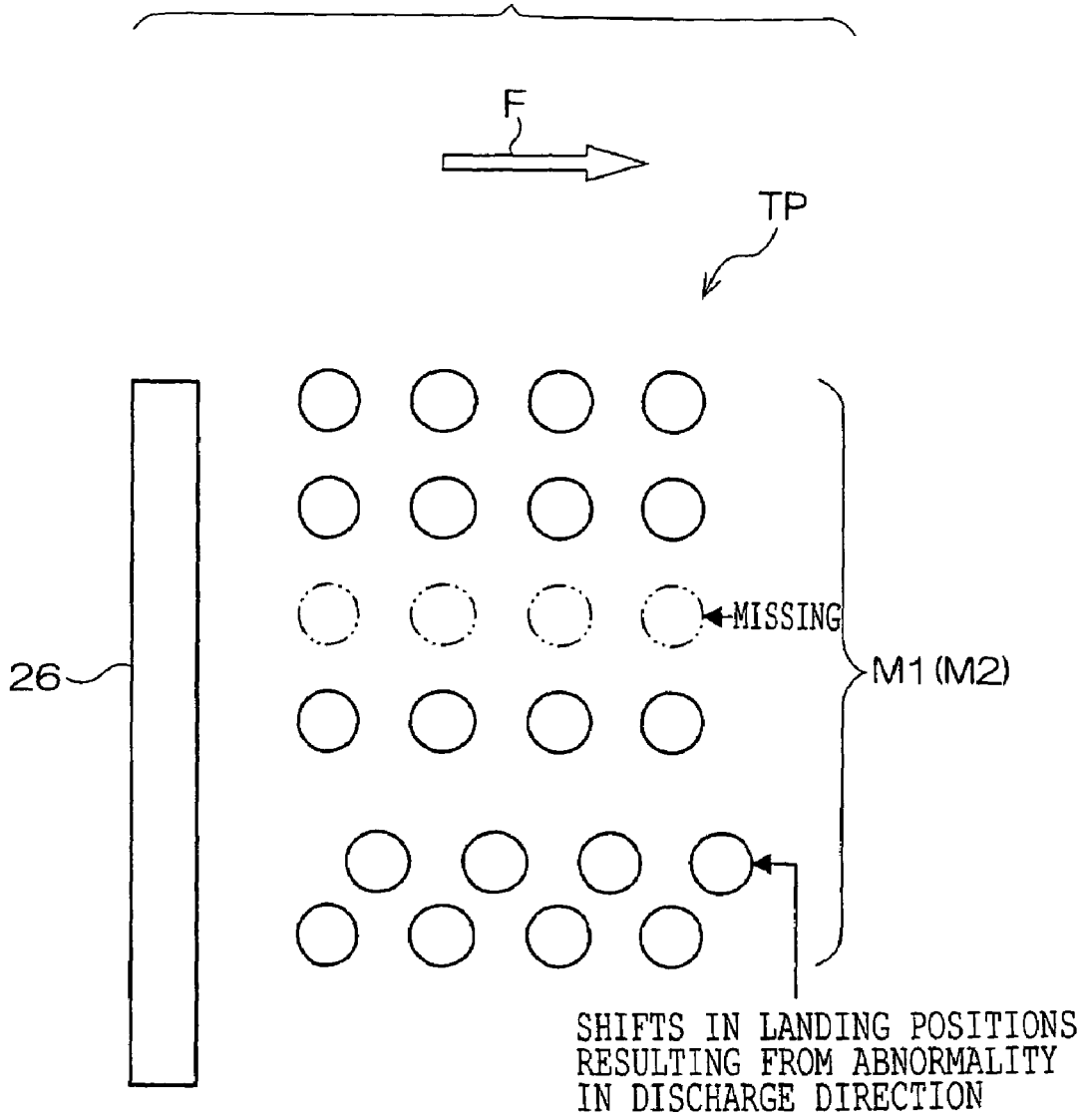
FIG. 13 is an explanatory diagram showing another example of a test pattern recorded in the ink droplet discharge position adjustment.

Next, the test pattern is recorded again on the paper P in step 110. In step 112, variations in the dots in the unit heads 26 are detected, and it is determined in step 114 whether or not these variations are within an allowable range. Namely, during inkjet recording, as shown in FIG. 13, there are cases where there are abnormalities in the discharge direction of the ink droplets resulting from the adherence of foreign matter to the nozzles 28 or where dots are missing due to clogging. When the variations are within the allowable range, the processing ends. When it is determined that the variations exceed the allowable range, 1 is added to the numerical value of the counter in step 116.

In step 118, it is determined whether or not the numerical value of the counter has reached a predetermined value (in FIG. 9, the value is set to "5"). When the numerical value of the counter has not reached the predetermined value, predetermined maintenance processing is conducted in step 120, and the discharge state is recovered. This maintenance processing includes cleaning of the ink discharge surface using an unillustrated wiping member and suction (vacuum operation) of the ink from the nozzles. The vacuum operation is conducted in a state where, as shown in FIG. 8B, the head recovery devices are lifted and the unit heads 26 are capped by the cap members 72. After this maintenance has been conducted, the processing returns to step 110 and the same processing is conducted thereafter.

When it is determined in step 118 that the numerical value of the counter has reached the predetermined value, it is conceivable that the unit heads 26 have failed and replacement thereof is necessary. Thus, in step 122, failure display where the fact that a specific recording head unit 22 (or unit head 26) has failed is displayed on a display unit such as a display panel 56, the user is prompted to replace the failed recording head unit 22 (or unit head 26), and processing ends. Even when failure display is done on the display unit, there are cases where the failure does not substantially become a problem depending on the type of image to be recorded. Also, in actual replacement, sometimes it takes time to procure a new recording head unit 22. Thus, it is preferable to enable continuous image recording by ensuring that the operation of the inkjet recording apparatus 12 is not completely stopped.

The above-described sequence includes a first portion where discharge position adjustment between the unit heads 26 is conducted (steps 102 to 106) and a second portion where discharge position adjustment in the unit heads 26 is conducted (steps 108 to 122), but simply the first portion may be conducted when the discharge position adjustment between the unit heads 26 is to be conducted. Similarly, simply the second portion may be conducted when the discharge position adjustment in the unit heads 26 is to be conducted.

Because the invention has the above-described configuration, production efficiency is raised and costs necessary to replace recording heads can be reduced.

As can be seen from the above description, in the inkjet recording apparatus according to the present invention, the plural recording heads are disposed in correspondence to plural individual recording regions divided in the recording medium width direction, so that overall, the inkjet recording heads can be made to correspond to the entire width of the recording medium. Thus, image recording along the entire width of the recording medium can be conducted by conveying the recording medium with the conveyance device. High productivity can be obtained because it is not necessary to move (main scan) the recording head units. Yield also becomes high because it is not necessary to make the unit heads configuring the recording head units long.

Moreover, the recording head units include plural unit heads that have different ink discharge characteristics and are unitized along the conveyance direction, and the recording head units can be replaced in recording head unit units, whereby costs necessary to replace the recording heads becomes lower.

With respect to the unit heads, "different ink discharge characteristics" widely includes discharging ink droplets of different colors, ink droplets of different droplet volumes, and that the characteristics of the ink droplets that are actually discharged are different. For example, it becomes possible to record a so-called full color image by configuring one recording head unit with four (or more) head units and configuring the head units to be able to discharge ink droplets of at least yellow (Y), magenta (M), cyan (C) and black (K).

The "recording medium" serving as the target of image recording in the inkjet recording apparatus of the present invention widely includes targets to which the inkjet recording apparatus discharges the ink droplets. Also, dot patterns on the recording medium obtained as a result of the ink droplets adhering to the recording medium are widely included in the "image" or "recording image" obtained with the recording apparatus of the present invention. Thus, the inkjet recording apparatus of the present invention is not limited to an apparatus used to record characters and images on recording paper. Of course, recording paper and OHP sheets are included in the recording medium, but in addition to these, substrates on which a wiring pattern is formed are also included. Also, included in the "image" are not only common images (characters, illustrations, photographs, etc.) but also the aforementioned wiring pattern, three-dimensional objects and organic thin films. The liquid to be discharged is also not limited to color ink. For example, the inkjet recording apparatus of the present invention can be applied to common droplet jetting devices used for various industrial purposes, such as the manufacture of color filters for displays conducted by discharging color ink onto a polymer film or glass, the formation of bumps for parts packaging conducted by discharging molten solder onto a substrate, the formation of EL display panels conducted by discharging an organic EL solution onto a substrate, and the formation of bumps for electrical packaging conducted by discharging molten solder onto a substrate.

What is claimed is:

1. An inkjet recording apparatus comprising:

conveyor devices for conveying a recording medium in a recording medium conveyance direction generally orthogonal to a recording medium width direction; and plural head units that are disposed in a staggered manner so that an imaginary line connecting the head units zigzags and extends in the recording medium width direction, with each head unit including plural unit heads arranged in the recording medium conveyance directions, wherein the conveyor devices include conveyance units for conveying the recording medium disposed in empty regions between the head units that are adjacent in the recording medium width direction.

2. The inkjet recording apparatus of claim 1, wherein each unit head includes plural ink discharge nozzles arranged in the recording medium width direction.

3. The inkjet recording apparatus of claim 2, wherein when Ln represents an inter-nozzle distance between the nozzles at both end sides of the unit heads in the recording medium width direction and W3 represents a substantially outer dimension of the head units in the recording medium width direction, W3<2×Ln.

4. The inkjet recording apparatus of claim 1, wherein the plural unit heads of one head unit have mutually different ink discharge characteristics.

5. The inkjet recording apparatus of claim 4, wherein the ink discharge characteristics include ink colors set per unit head.

6. The inkjet recording apparatus of claim 1, wherein each head unit includes four unit heads where inks of yellow (Y), magenta (M), cyan (C) and black (K) are allocated.

7. The inkjet recording apparatus of claim 1, wherein each head unit is detachably independent from the other head units.

8. The inkjet recording apparatus of claim 1, wherein the plural head units are included in a head unit row at the upstream side of the recording medium conveyance direction and a head unit row at the downstream side of the recording medium conveyance direction.

9. The inkjet recording apparatus of claim 8, wherein each of the head unit rows is configured by the head units arranged in the recording medium width direction with predetermined intervals disposed therebetween.

10. The inkjet recording apparatus of claim 1, further comprising a reading device that can read a predetermined test pattern recorded by the head units, and a display device that can display, on the basis of the reading result, at least one of a head unit and a unit head that is to be replaced.

11. The inkjet recording apparatus of claim 1, wherein each of the conveyance units includes a conveyor belt.

12. The inkjet recording apparatus of claim 1, further comprising plural head recovery devices corresponding to the head units.

13. The inkjet recording apparatus of claim 12, wherein each of the head recovery devices includes a cap member that can cover all of the unit heads of the corresponding head units.

14. The inkjet recording apparatus of claim 13, wherein each of the cap members is separably for movable the covering with respect to the corresponding head units.

15. An inkiet recording apparatus comprising:

plural head units that are disposed in a staggered manner so that an imaginary line connecting the head units zigzags and extends in a first direction;

plural head recovery devices that are disposed facing the head units; and plural conveyance units for conveying a recording medium in a second direction intersecting the first direction, the conveyance units being disposed adjacent to the head recovery devices.

16. The inkjet recording apparatus of claim 15, wherein at least one of the conveyance units is disposed between the head recovery devices.

* * * * *